US007305926B2

(12) United States Patent
Seider

(10) Patent No.: US 7,305,926 B2
(45) Date of Patent: Dec. 11, 2007

(54) PORTED TRI-HULL BOAT

(76) Inventor: Dennis J. Seider, 865 S. Figueroa St., Suite 3200, Los Angeles, CA (US) 90017

( * ) Notice: Subject to any disclaimer, the term of this patent is extended or adjusted under 35 U.S.C. 154(b) by 0 days.

(21) Appl. No.: 11/450,505

(22) Filed: Jun. 9, 2006

(65) Prior Publication Data

US 2006/0288922 A1 Dec. 28, 2006

Related U.S. Application Data

(60) Provisional application No. 60/689,429, filed on Jun. 10, 2005.

(51) Int. Cl.
*B63B 1/00* (2006.01)

(52) U.S. Cl. ..... 114/61.1; 114/292

(58) Field of Classification Search ..... 114/61.1, 114/123, 274, 283, 292
See application file for complete search history.

(56) References Cited

U.S. PATENT DOCUMENTS

| | | | | |
|---|---|---|---|---|
| 3,308,780 | A | 3/1967 | Abramson | |
| 3,847,103 | A * | 11/1974 | Takeuchi | 114/61.1 |
| RE31,563 | E | 4/1984 | Stout et al. | |
| 4,672,905 | A | 6/1987 | Pipkorn | |
| 4,821,663 | A | 4/1989 | Schad | |
| 4,924,797 | A | 5/1990 | Solia | |
| 5,016,552 | A | 5/1991 | Ludlow | |
| 5,125,352 | A | 6/1992 | Shields | |
| 5,655,473 | A | 8/1997 | Arvilla | |
| 5,918,562 | A | 7/1999 | Macchio | |
| 6,216,622 | B1 | 4/2001 | Lindstrom et al. | |
| 6,425,341 | B1 | 7/2002 | Devin | |
| 6,526,903 | B2 | 3/2003 | Robinson et al. | |

OTHER PUBLICATIONS

"Trimaran to Dominate High Speed Transport" published Apr. 13, 2005; printed Jun. 8, 2005 from www.austal.com/news/article.cfm?news_id=123.

* cited by examiner

*Primary Examiner*—Stephen Avila
(74) *Attorney, Agent, or Firm*—Lauson & Schewe LLP; Robert J. Lauson; Edward C. Schewe

(57) ABSTRACT

A boat for traveling at speed across a body of water includes a center hull having a vee-shaped bottom with a center planing surface, and an opposing pair of sponsons or ski-like structures attached outboard of the center and extending substantially alongside the central hull. Importantly, the sponsons or skis each have a substantial opening such that large volumes of water are able to pass through in an outboard direction away from the boat, advantageously minimizing forces on the hull when there is substantial vertical downward movement of the boat. The boat is designed so that planing surfaces of the keel and sponsons operate beneath the surface of the water to lift the hull free and isolate it from the rough water surface.

6 Claims, 7 Drawing Sheets

PORTED TRI-HULL BOAT

CROSS REFERENCE TO RELATED DOCUMENTS

This application is based on provisional patent application Ser. No. 60/689,429 filed Jun. 10, 2005, the contents of which are incorporated by reference.

BACKGROUND OF THE INVENTION

1. Field of the Invention

The present invention relates generally to watercraft designs and more particularly to a tri-hull power boat having specially-designed sponsons for top performance and a comfortable ride.

2. Description of the Related Art

Boat designs vary considerably depending upon the specific use for which the boat is planned. Displacement vessels move through the water comfortably but slowly, while planing vessels rise and ride on top of the water when power is applied but the ride can be jarring as the boat contacts the surface of the water. Monohull vee-bottom boats are strong and can displace water to the sides but do not have the smooth ride of a surface piercing design and are slowed by the amount of wetted surface. Multi-hull designs are also popular with the surface piercing and wider stance offering greater comfort and stability but are of limited use in rough water because of the tendency to. "bottom out," i.e., when coming down hard on the surface of the water at speed caused by the surface hitting that portion of the hull that joins the sponsons together. Tunnel boats are designed to trap a cushion of air beneath the hull to reduce drag but also suffer in rough water and can bottom out. Other boats have been designed to ride on foils or skis, typically attached to the vessel by struts which are subject to damage from impact or mechanical failure.

OBJECTS OF THE INVENTION

Accordingly, it is an object of the present invention to provide a scalable fast, wave/surface piercing tri-hull vessel offering the strength of a monohull, the ride of a hydrofoil, the stability of a tri-hull and the ability to combine the advantages of all three types of hulls at high speed and in a variety of sea states.

It is a further object of the present invention to provide a tri-hull design which allows the vessel to rise partially out of the water generally isolating the vessel from the surface and that will run efficiently at high speed with minimum wetted surface.

It is a still further object of the present invention to provide a tri-hull design allowing the vessel to come down at great speed on the surface of the water without bottoming out by pushing the water to the side, rather than trapping the water against the outside sponsons as in a conventional tri-hull which otherwise has its downward momentum stopped abruptly by the trapped water, often causing a jarring impact and loss of speed.

It is a still further object of the present invention to provide a tri-hull vessel that rises far enough from the surface at speed as to allow greater vertical downward movement without impact on the bottom portion of the hull riding above the surface.

It is a still further object of the present invention to provide a tri-hull boat with generally open outboard sponsons allowing water to escape the sides of the vessel at speed.

It is a further object of the present invention to have the sponson structure rigidly affixed or integrated into the hull eliminating the need for maintaining moveable planing equipment, struts or foils.

These and other objects and advantages of the present invention will become apparent upon reading the following detailed description and upon reference to the accompanying drawings.

SUMMARY OF THE INVENTION

A boat for traveling at speed across a body of water includes a center hull having a generally curved bottom with a center planing surface, and an opposing pair of sponsons or ski-like structures attached outboard of the center and extending substantially alongside the hull from the bow to the stern of the boat, and each of the sponsons having a planing surface in approximately the same plane as the central planing surface. Importantly, the sponsons or skis each have a substantial opening or other porting means such that large volumes of water are able to pass in an outboard direction through the sponsons and away from the center hull outward from the sides of the boat. Advantageously, this reduces forces on the hull when there is substantial vertical downward movement of the boat.

Preferably the center hull and sponson planing surfaces are all long enough to pierce the water, isolating the majority of the hull from the surface and extending longitudinally and widening towards the stern of the boat. Also preferably, the central hull and sponsons are generally sharp and vee shaped at the bow portion of the boat to achieve surface piercing and then flatten out towards the stern. The boat is designed so that planing surfaces of the keel and sponsons operate beneath the surface of the water to lift the hull free of and to isolate it from the rough water surface.

LISTING OF REFERENCE NUMERALS FOR PREFERRED EMBODIMENT

Figure 1:
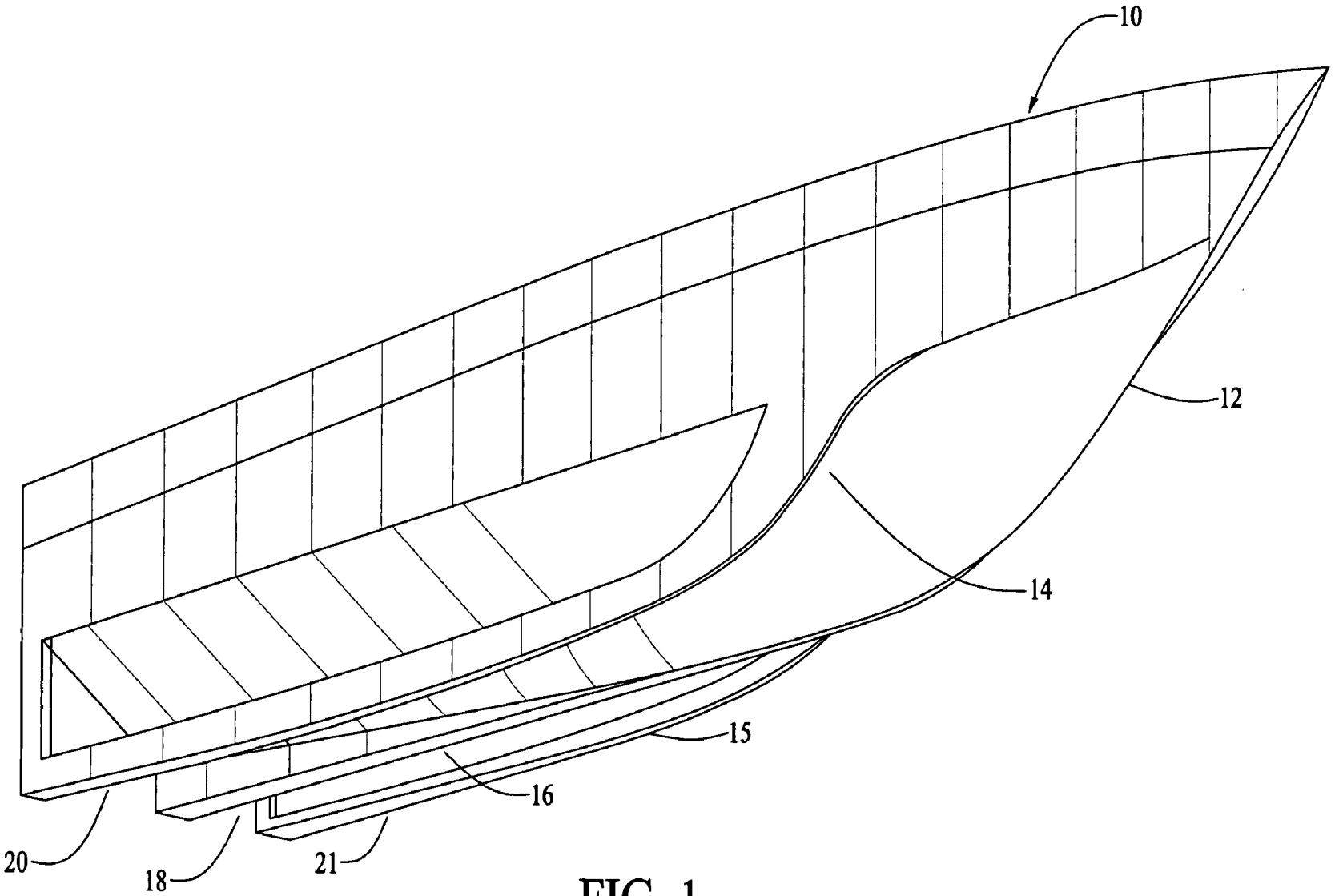
FIG. 1 is a side perspective view of the ported tri-hull boat design of the preferred embodiment of the present invention.
Figure 2:
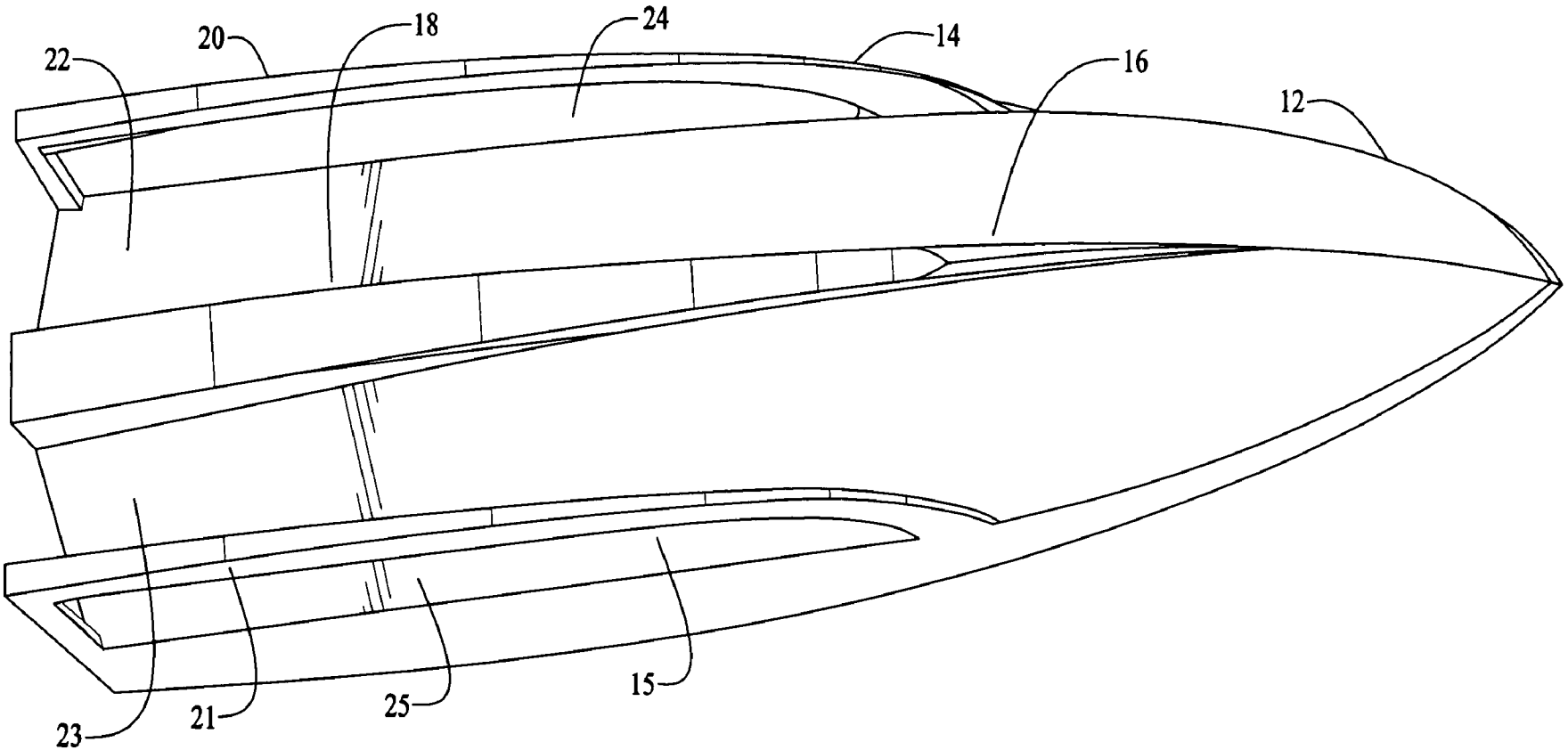
FIG. 2 is a bottom perspective view of the same.
Figure 3:
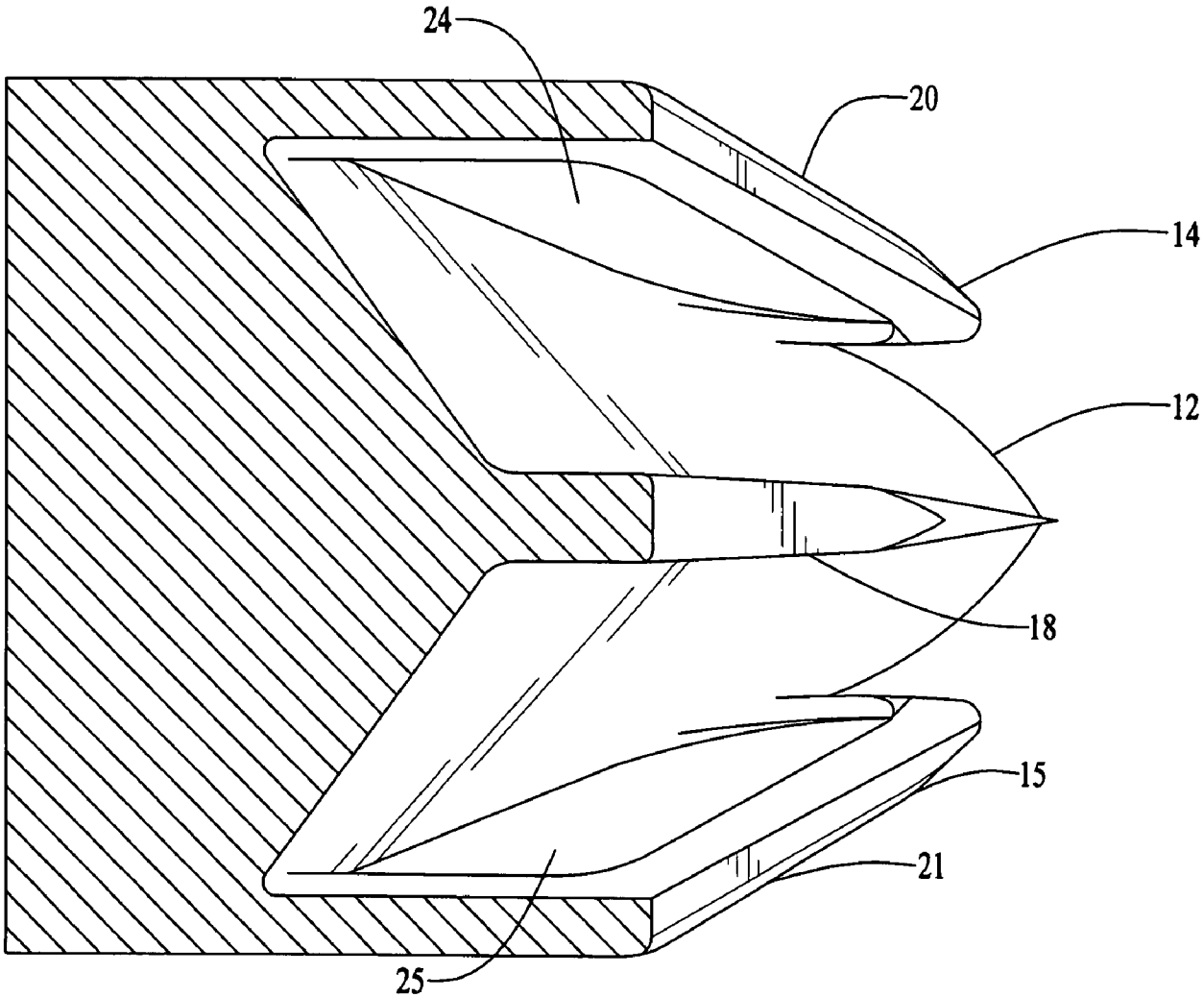
FIG. 3 is a rear perspective view.
Figure 4:
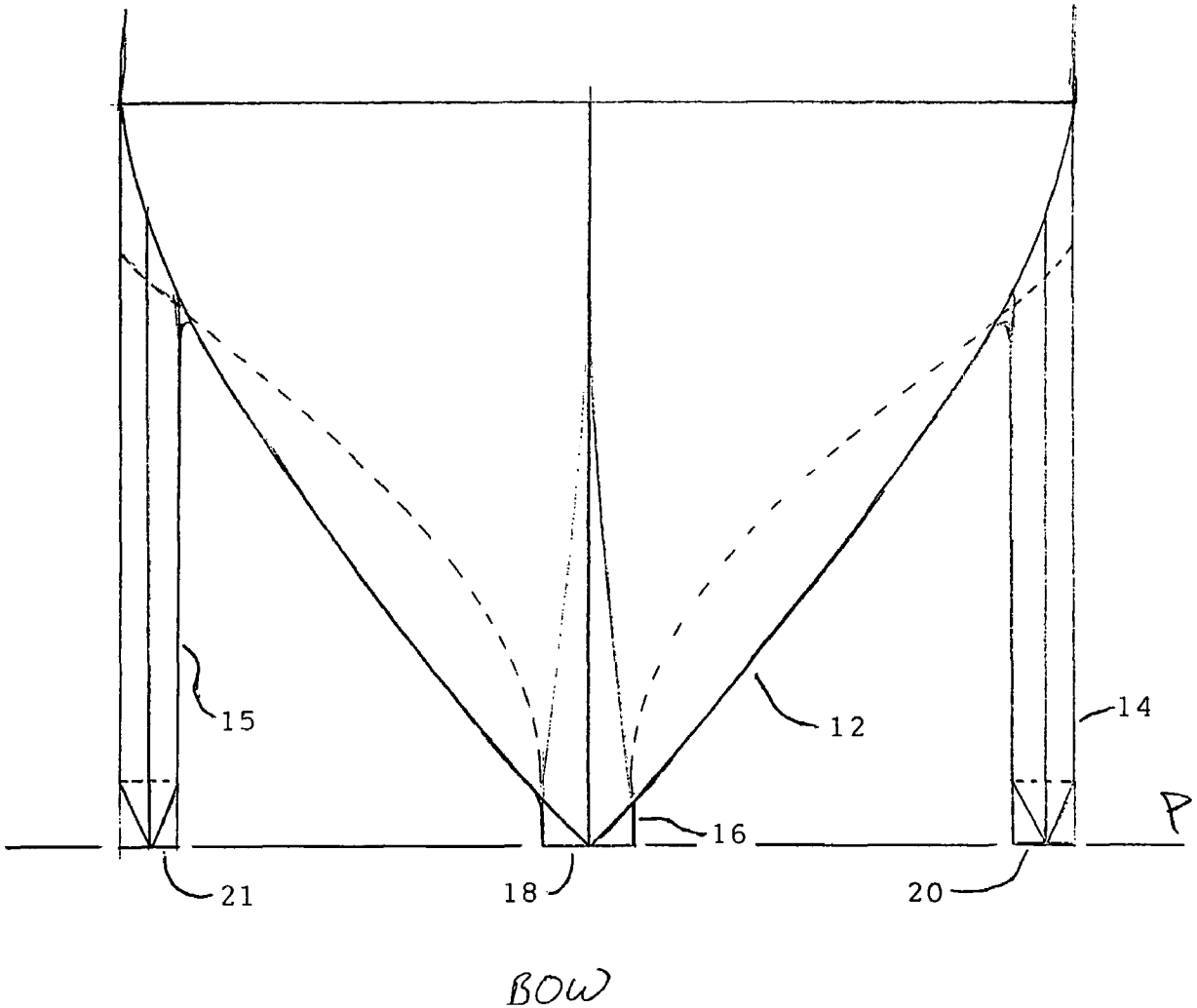
FIG. 4 is a front view.
Figure 5:
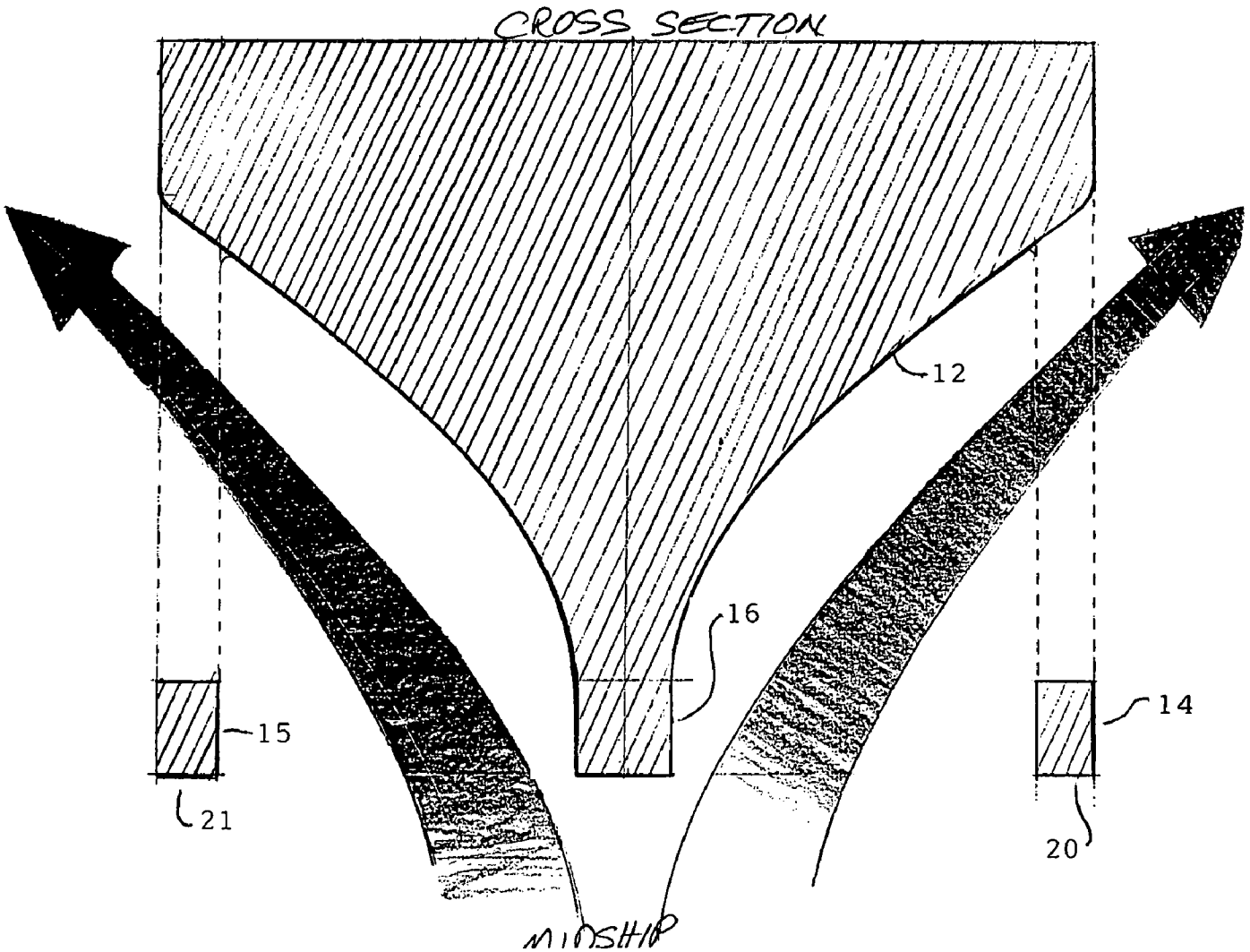
FIG. 5 is a mid-ship cross-sectional view (looking aft) with directional arrows showing the water flow through the sponsons.
Figure 6:
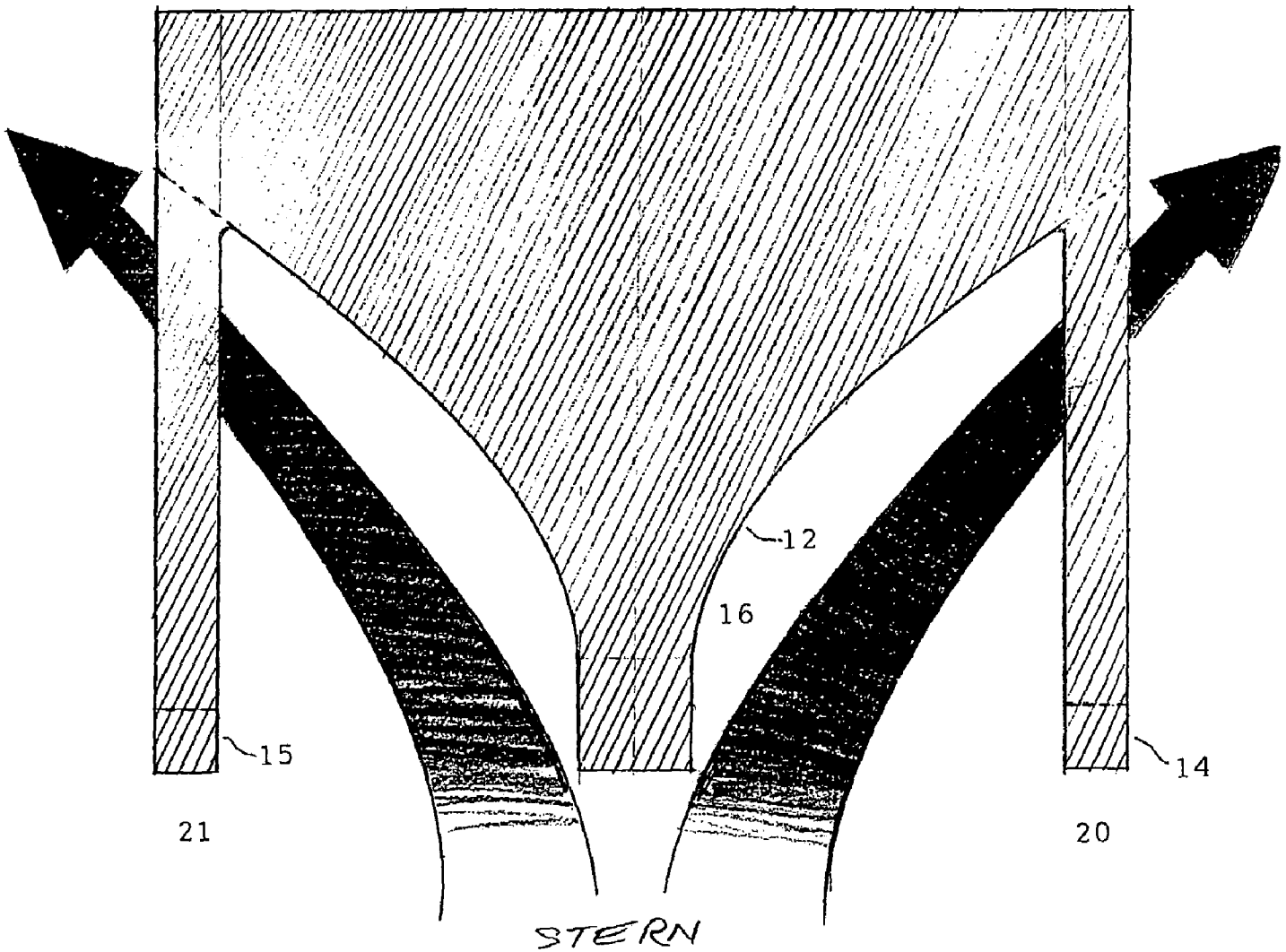
FIG. 6 is a stern cross-sectional view (still looking aft) of the same.

| | |
|---|---|
| tri-hull boat | 10 |
| center hull | 12 |
| opposing pair of sponsons or skis | 14, 15. |
| keel | 16 |
| center planing surface | 18 |
| outboard planing surfaces | 20, 21 |
| aft center hull structure | 22, 23 |
| sponson openings or ports | 24, 25 |
| plane | P |

DESCRIPTION OF THE PREFERRED EMBODIMENT(S)

Referring to FIGS. 1-6 the preferred embodiment of the present invention may be described. First referring primarily to FIGS. 1-4, shown is a tri-hull boat 10 includes a vessel having a generally vee-shaped center hull 12 with an opposing pair of sponsons or skis 14, 15. The center hull 12 at the chine has a keel 16 that runs longitudinally from the bow to the stern portions of the boat, and flattens out and substantially widens as it extends aft to form a center planing surface 18. Similarly the sponsons 14, 15 are vee shaped at the bow and flatten and widen towards the stern forming outboard planing surfaces 20, 21, all those planning surfaces 20, 21 and the central planning surface 18 being in approximately the same plane P. The deadrise angle of the center hull 12 is preferably in the range of about 20 to 30 degrees at the midship portion of the boat. At the stern the central hull 12 remains generally vee-shaped extending towards the sponsons 14, 16 with aft surfaces 22, 23 well above the planing surfaces 20, 21 of the sponsons 14, 15.

Figure 7:
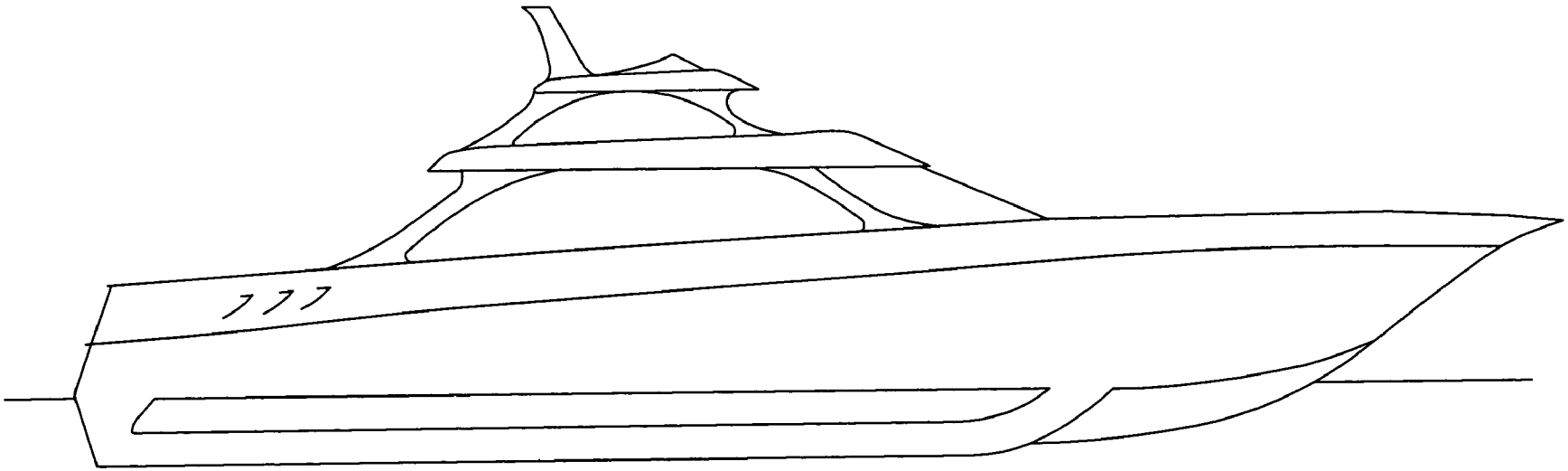
FIG. 7 is a perspective view of a boat incorporating the ported tri-hull design.

Preferably the sponsons 14, 15 are integrated into the center hull 12 rather than being separate attachable structures. The sponsons 14, 15 are configured to have large openings or ports 24, 25 allowing the rapid passage of substantial volumes of water from between the center hull 12 and sponsons 14, 15 to outboard of the boat 10. See FIGS. 5. 6 showing upward and sideways flow of water through the sponsons 14, 15. As described above, this occurs when there is a sudden downward movement of the boat 10 relative the surface of the water, and dispersing the water outboard of the center hull 12 preventing substantial forces from bearing on the hull 12 and jarring the occupants of the boat 10. FIG. 7 shows a powerboat incorporating the tri-hull design 10 and indicates generally where the water line is intended to lie.

While particular forms of the invention have been illustrated and described, it will also be apparent to those skilled in the art that various modifications can be made without departing from the spirit and scope of the invention. Accordingly, it is not intended that the invention be limited except by the appended claims.

What is claimed is:

1. A boat for traveling at speed across a water surface comprising:

a center hull having a generally curved bottom with a center planing surface defining a plane;

a pair of sponsons with one of each attached to opposite sides of the boat outboard of the center planing surface and extending substantially alongside the central hull from the bow portion to the stern portion of the boat, and each of the sponsons further having a planing surface in approximately said plane of the central planing surface; and, the sponsons further each having an opening sized and configured for dispersing of water displaced by downward movement of the central hull thereby reducing forces on the hull.

2. The boat of claim 1 wherein the center hull has a keel extending longitudinally and forming the center planing surface and widening towards the stern portion of the boat.

3. The boat of claim 2 wherein the central hull and sponsons are generally vee shaped at the bow portion of the boat and transition to generally flatter surfaces towards the stern portion of the boat.

4. The boat of claim 3 wherein at the stern portion of the boat the central hull extends from the central planing surface towards the sponsons upwardly well above the planing surfaces of the sponsons.

5. A boat comprising:

a center hull having a generally curved bottom with a center planing surface defining a plane;

a pair of opposing sponsons each integrated into the center hull outboard of the center planing surface and extending substantially alongside the central hull from the bow portion to the stern portion of the boat, and each of the sponsons having a planing surface in approximately the same plane as the central planing surface;

the sponsons further each having porting means to pass large volumes of water outboardly therethrough.

6. The boat of claim 5 wherein the center hull is generally vee-shaped from the bow portion to the stern portion of the boat.

* * * * *